US007173577B2

(12) United States Patent
Brown et al.

(10) Patent No.: US 7,173,577 B2
(45) Date of Patent: Feb. 6, 2007

(54) FREQUENCY SELECTIVE SURFACES AND PHASED ARRAY ANTENNAS USING FLUIDIC DIELECTRICS

(75) Inventors: Stephen Brown, Palm Bay, FL (US); James Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 102 days.

(21) Appl. No.: 11/159,434

(22) Filed: Jun. 21, 2005

(65) Prior Publication Data

US 2005/0237267 A1 Oct. 27, 2005

Related U.S. Application Data

(62) Division of application No. 10/647,764, filed on Aug. 25, 2003, now Pat. No. 6,927,745.

(51) Int. Cl.
*H01Q 15/24* (2006.01)

(52) U.S. Cl. ..... 343/909

(58) Field of Classification Search ..... 343/909, 343/781 P, 781 CA, 757, 779, 781, 912
See application file for complete search history.

(56) References Cited

U.S. PATENT DOCUMENTS 3,995,277 A 11/1976 Olyphant, Jr.
5,162,972 A 11/1992 Gripshover et al.
5,485,167 A 1/1996 Wong et al.
5,497,168 A 3/1996 Thomas et al.
5,534,869 A 7/1996 Harman
5,990,851 A * 11/1999 Henderson et al. ..... 343/915
6,115,003 A * 9/2000 Kozakoff ..... 343/840
6,392,611 B1 5/2002 Smith et al.
6,417,813 B1 7/2002 Durham
6,456,254 B1 9/2002 Reineix et al.
6,473,057 B2 10/2002 Monzon
6,512,496 B2 * 1/2003 Alexeff et al. ..... 343/915
6,515,235 B2 2/2003 Moller
6,650,304 B2 11/2003 Lee et al.
6,683,751 B2 1/2004 Tobitsuka et al.
6,806,416 B1 10/2004 Pike
6,870,439 B2 3/2005 Rawnick et al.
6,873,229 B2 3/2005 Pike
6,873,305 B2 3/2005 Rawnick et al.
6,876,274 B2 4/2005 Rawnick et al.
6,876,278 B2 4/2005 Rawnick et al.

(Continued)

*Primary Examiner*—Trinh Dinh
*Assistant Examiner*—Huedung Mancuso
(74) *Attorney, Agent, or Firm*—Sacco & Associates, PA; Robert J. Sacco

(57) ABSTRACT

A phased array antenna (100) having a frequency selective surface comprises a substrate (125) and an array of antenna elements (140) thereon. Each antenna element comprises a medial feed portion (42) and a pair of legs (49) extending outwardly therefrom. Adjacent legs of adjacent antenna elements include respective spaced apart end portions (51). The antenna further comprises at least one fluidic dielectric residing within at least one cavity (170) within the substrate and arranged between a plane where the array of dipole antenna elements reside and a ground plane (150), at least one composition processor (104) adapted for dynamically changing a composition of said fluidic dielectric, and a controller (102) for controlling the composition processor to selectively vary at least one of a permittivity and a permeability of the fluidic dielectric in at least one cavity in response to a control signal (105).

22 Claims, 7 Drawing Sheets

U.S. PATENT DOCUMENTS

| | | | | |
|---|---|---|---|---|
| 6,879,297 | B2 | 4/2005 | Rawnick et al. | |
| 6,888,422 | B2 | 5/2005 | Rawnick et al. | |
| 6,888,500 | B2 | 5/2005 | Rawnick et al. | |
| 6,891,501 | B2 | 5/2005 | Rawnick et al. | |
| 6,894,591 | B2 | 5/2005 | Rawnick et al. | |
| 6,894,652 | B2 | 5/2005 | Rawnick et al. | |
| 6,897,820 | B2 * | 5/2005 | Frenkel | 343/756 |
| 6,900,763 | B2 * | 5/2005 | Killen et al. | 343/700 MS |
| 2003/0156983 | A1 | 8/2003 | Rawnick et al. | |
| 2004/0155727 | A1 | 8/2004 | Rawnick et al. | |
| 2004/0178865 | A1 | 9/2004 | Rawnick et al. | |
| 2004/0178966 | A1 | 9/2004 | Rawnick et al. | |
| 2004/0207481 | A1 | 10/2004 | Brown et al. | |
| 2004/0207494 | A1 | 10/2004 | Brown et al. | |
| 2004/0227687 | A1 | 11/2004 | Killen et al. | |
| 2004/0227691 | A1 | 11/2004 | Rawnick et al. | |
| 2004/0239577 | A1 | 12/2004 | Killen et al. | |
| 2004/0252058 | A1 | 12/2004 | Rawnick et al. | |
| 2004/0252069 | A1 | 12/2004 | Rawnick et al. | |
| 2005/0007209 | A1 | 1/2005 | Rawnick et al. | |
| 2005/0017819 | A1 | 1/2005 | Rawnick et al. | |
| 2005/0017915 | A1 | 1/2005 | Rawnick et al. | |
| 2005/0024167 | A1 | 2/2005 | Rawnick et al. | |
| 2005/0024629 | A1 | 2/2005 | Pike | |
| 2005/0030133 | A1 | 2/2005 | Rawnick et al. | |
| 2005/0030240 | A1 | 2/2005 | Rawnick et al. | |

* cited by examiner

FREQUENCY SELECTIVE SURFACES AND PHASED ARRAY ANTENNAS USING FLUIDIC DIELECTRICS

This application is a divisional of U.S. application Ser. No. 10/647,764, filed on Aug. 25, 2003, now U.S. Pat No. 6,927,745

BACKGROUND OF THE INVENTION

1. Statement of the Technical Field

The inventive arrangements relate generally to the field of communications, and more particularly to frequency selective surfaces and phased array antennas.

2. Description of the Related Art

Existing microwave antennas include a wide variety of configurations for various applications, such as satellite reception, remote broadcasting, or military communication. The desirable characteristics of low cost, light-weight, low profile and mass producibility are provided in general by printed circuit antennas. The simplest forms of printed circuit antennas are microstrip antennas where flat conductive elements are spaced from a single essentially continuous ground element by a dielectric sheet of uniform thickness. An example of a microstrip antenna is disclosed in U.S. Pat. No. 3,995,277 to Olyphant.

These antennas can be designed in an array and may be used for communication systems such as identification of friend/foe (IFF) systems, personal communication service (PCS) systems, satellite communication systems, and aerospace systems, which require such characteristics as low cost, light weight, low profile, and a low sidelobe.

The bandwidth and directivity capabilities of such antennas, however, can be limiting for certain applications. While the use of electromagnetically coupled microstrip patch pairs can increase bandwidth, obtaining this benefit presents significant design challenges, particularly where maintenance of a low profile and broad beam width is desirable or where a dynamically manipulated beam is desirable. Also, the use of an array of microstrip patches can improve directivity by providing a predetermined scan angle. However, utilizing an array of microstrip patches presents a dilemma. The scan angle can be increased if the array elements are spaced closer together, but closer spacing can increase undesirable coupling between antenna elements thereby degrading performance.

Furthermore, while a microstrip patch antenna is advantageous in applications requiring a conformal configuration, e.g. in aerospace systems, mounting the antenna presents challenges with respect to the manner in which it is fed such that conformality and satisfactory radiation coverage and directivity are maintained and losses to surrounding surfaces are reduced. More specifically, increasing the bandwidth of a phased array antenna with a wide scan angle is conventionally achieved by dividing the frequency range into multiple bands.

One example of such an antenna is disclosed in U.S. Pat. No. 5,485,167 to Wong et al. This antenna includes several pairs of dipole pair arrays each tuned to a different frequency band and stacked relative to each other along the transmission/reception direction. The highest frequency array is in front of the next lowest frequency array and so forth.

This approach may result in a considerable increase in the size and weight of the antenna while creating a Radio Frequency (RF) interface problem. Another approach is to use gimbals to mechanically obtain the required scan angle. Yet, here again, this approach may increase the size and weight of the antenna and result in a slower response time. The present invention utilizes a reconfigured frequency selective surface to avoid many of these detriments.

A frequency selective surface is typically an array of periodic elements used to tightly couple resonant elements such as dipoles, slots and spatial filters that reflect. A frequency selective surface is also considered a construction that either passes or reflects certain frequencies.

Thus, there is a need for a frequency selective surface as well as a lightweight phased array antenna with a wide frequency bandwidth and a wide scan angle utilizing such frequency selective surface, and that can be conformably mountable to a surface if required. Such a need has been met through the use of current sheet arrays or dipole layers using interdigital capacitors that increase coupling by lengthening the capacitor "digits" or "fingers" that result in additional bandwidth as discussed in U.S. Pat. No. 6,417,813 to Durham ('813 Patent) and assigned to the assignee herein. Some antennas of this structure exhibit a significant gain dropout at particular frequencies in the desired operational bandwidth, spurious resonances, and possibly other undesirable characteristics. Being able to change the phase response or the resonant frequency across the frequency selective surface can likely remove most of these undesirable characteristics. Thus, a need exists for a lightweight phased array antenna with a wide frequency bandwidth and wide scan angle that overcomes the gain dropout and other undesirable characteristics discussed above.

The key to broad-band performance with a phased array antenna incorporating a frequency selective surface is to achieve constant impedance over a wide frequency range. None of the constituent components of such an array (e.g. the elements, the unit cell spacing, the mutual coupling, the dielectric properties of the material layers in which the array is embedded, and the spacing between the array and the ground plane, if any) have this constant impedance property. However, the impedance properties of the components all vary differently with frequency. With appropriate choices in accordance with the invention, these individual variations can be made to balance over a broad frequency range, so that collectively, but not individually, the design elements of the array achieve broadband performance. Note that this design approach utilizes the coupling between the elements, whereas in other array designs the coupling is considered undesirable.

In practice, the present state of the art in such arrays is limited to about 10:1 bandwidth. This is much broader bandwidth than has been achieved with other arrays, but there are applications which could benefit from even more bandwidth. The limitations in practice arise from a number of factors, including undesired resonances in the array design, e.g. in the coupling structure, and the desired scanning performance of the array. Embodiments in accordance with the present invention utilize fluids to extend the range over which the array operates, allowing the instantaneous bandwidth of the array to be utilized over an even wider operating range. Examples of the array parameters which could be affected by fluids are the coupling structures, the element resonances, and the effective ground plane spacing.

SUMMARY OF THE INVENTION

In a first aspect of the present invention, a phased array antenna having a frequency selective surface comprises a substrate and an array of antenna elements thereon. Each antenna element comprises a medial feed portion and a pair of legs extending outwardly therefrom. Adjacent legs of adjacent antenna elements include respective spaced apart end portions. The antenna further comprises at least one fluidic dielectric residing within at least one cavity within the substrate and arranged between a plane where the array of dipole antenna elements reside and a ground plane, at least one composition processor adapted for dynamically changing a composition of said fluidic dielectric to vary at least one of said permittivity and said permeability in said at least one cavity, and a controller for controlling the composition processor to selectively vary at least one of a permittivity and a permeability of the fluidic dielectric in at least one cavity in response to a control signal.

In a second aspect of the present invention, a phased array antenna comprises a substrate and an array of antenna elements thereon, at least one fluidic dielectric having a permittivity and a permeability able to reside within at least one cavity within at least one dielectric layer, wherein the dielectric layer resides between the substrate and a ground plane. The antenna further comprises at least one composition processor adapted for dynamically changing a composition of the fluidic dielectric in the at least one cavity and a controller for controlling the composition processor to selectively vary at least one of the permittivity and the permeability in at least one cavity in response to a control signal.

In a third aspect of the present invention, a phased array antenna comprises a current sheet array on a substrate, at least one dielectric layer between the current sheet array and a ground plane, and at least one cavity within the at least one dielectric layer for retaining at least one fluidic dielectric. The antenna can further include at least one fluidic pump unit for adding and removing the fluid dielectric to or from the at least one cavity in response to a control signal.

In yet another aspect of the present invention, a method for beam forming a radio frequency signal radiated from an antenna using a frequency selective surface comprises the steps of propagating the radio frequency signal through the frequency selective surface and dynamically changing the composition of a fluidic dielectric within the frequency selective surface to vary at least one among a permittivity and a permeability in order to vary a propagation delay of said radio frequency signal through the frequency selective surface.

The spaced apart end portions of the dipole antenna elements can preferably have a predetermined shape and be relatively positioned to provide increased capacitive coupling between the adjacent dipole antenna elements. The spaced apart end portions in adjacent legs can comprise interdigitated portions, and each leg can have an elongated body portion, an enlarged width end portion connected to an end of the elongated body portion, and a plurality of fingers, e.g. four, extending outwardly from the enlarged width end portion.

The wideband phased array antenna has a desired frequency range and the spacing between the end portions of adjacent legs is less than about one-half a wavelength of a highest desired frequency. Also, the array of (dipole) antenna elements may include first and second sets of orthogonal dipole antenna elements to provide dual polarization. A ground plane is preferably provided adjacent the array of dipole antenna elements and is spaced from the array of dipole antenna elements less than about one-half a wavelength of a highest desired frequency.

Preferably, each dipole antenna element comprises a printed conductive layer, and the array of dipole antenna elements can be arranged at a density in a range of about 100 to 900 per square foot. The array of dipole antenna elements is sized and relatively positioned so that the wideband phased array antenna is operable over a frequency range of about 2 to 30 GHz, and at a scan angle of about ±60 degrees. There may be at least one dielectric layer on the array of dipole antenna elements, and the flexible substrate may be supported on a rigid mounting member having a non-planar three-dimensional shape.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notation are used to indicate similar elements in alternative embodiments.

Figure 1:
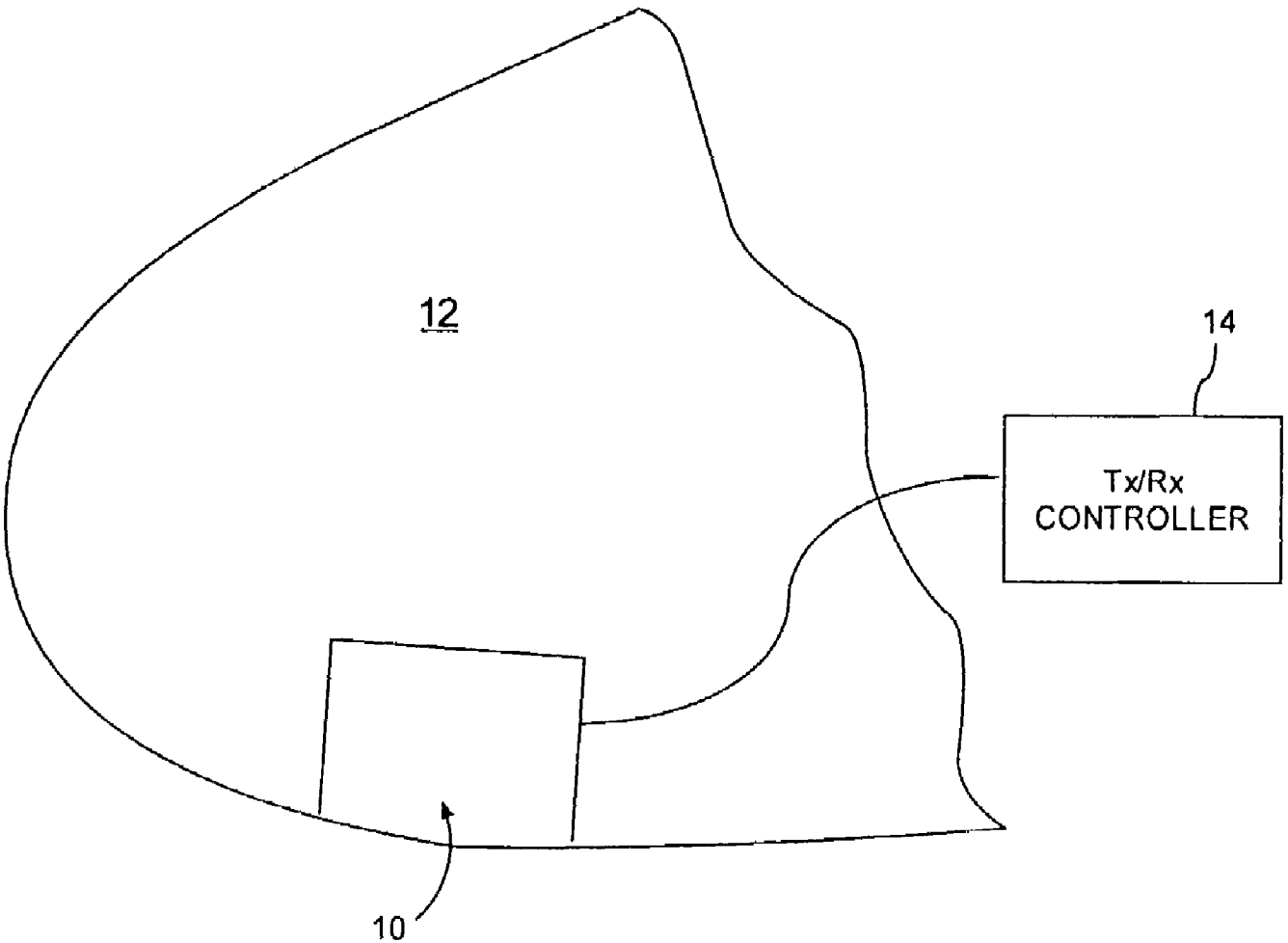
FIG. 1 is a schematic diagram illustrating the wideband phased array antenna in accordance with the present invention mounted on the nosecone of an aircraft, for example.
Figure 2:
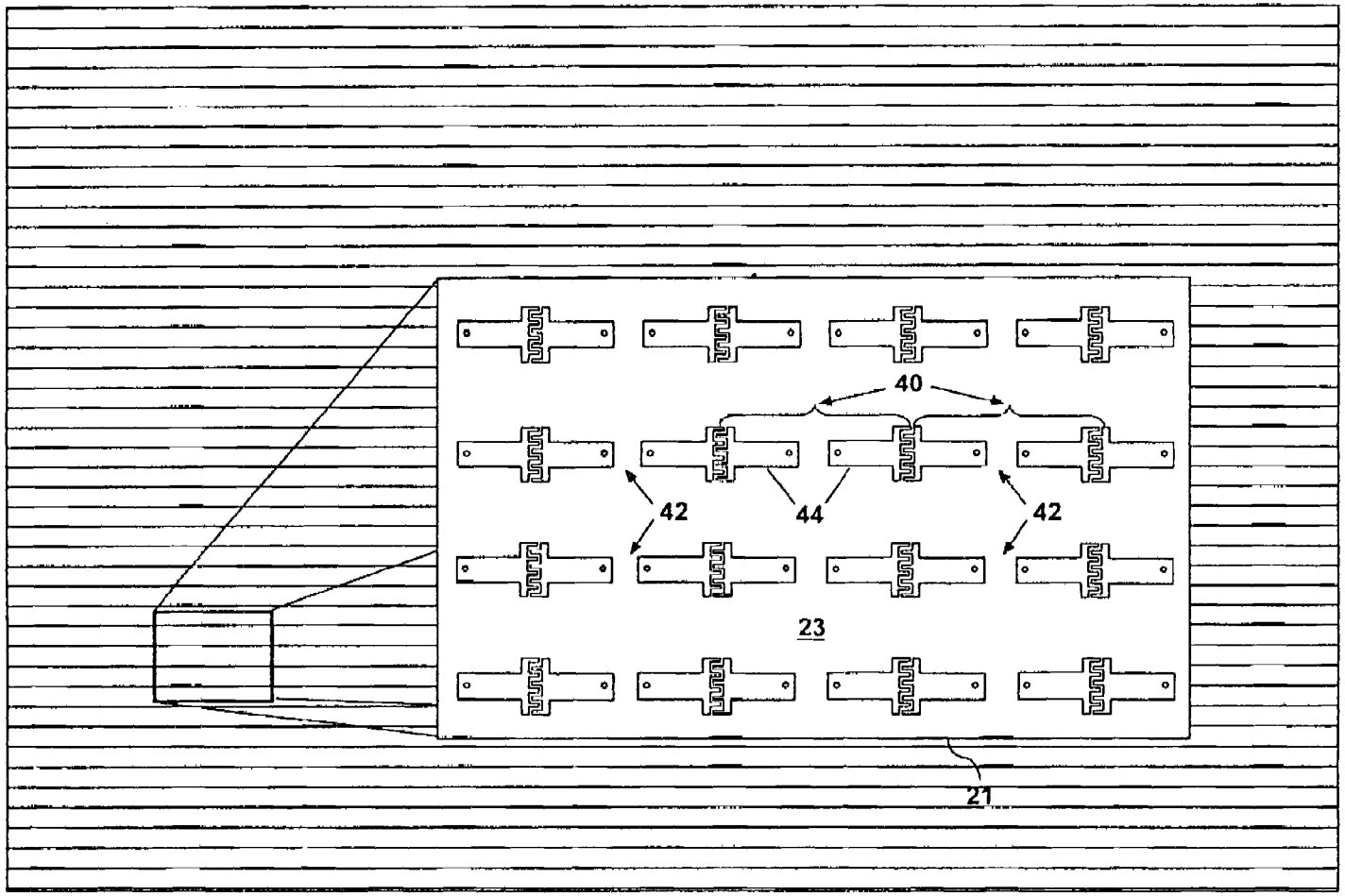
FIG. 2 is a schematic diagram of the printed conductive layer of the wideband phased array antenna of FIG. 1.

Referring initially to FIGS. 1 and 2(A–C), a wideband phased array antenna 10 in accordance with the present invention is illustrated. The antenna 10 may be mounted on the nosecone 12, or other rigid mounting member having either planar or a non-planar three-dimensional shape, of an aircraft or spacecraft, for example, and may also be connected to a transmission and reception controller 14 as would be appreciated by the skilled artisan.

The wideband phased array antenna 10 is preferably formed of a plurality of flexible layers as shown in FIGS. 6 and 7. These layers can include a dipole layer or current sheet array, which is sandwiched between a ground plane and an outer dielectric layer such as the outer dielectric layer of foam. Other dielectric layers and at least one coupling plane could be included. It should be noted that the coupling plane can be embodied in many different forms including planes that are only partially metalized or fully metalized, coupling planes that reside above or below the dipole layer, or multiple coupling planes that can reside either above or below the dipole layer or both. The dielectric layers may have tapered dielectric constants to improve the scan angle.

Figure 3:
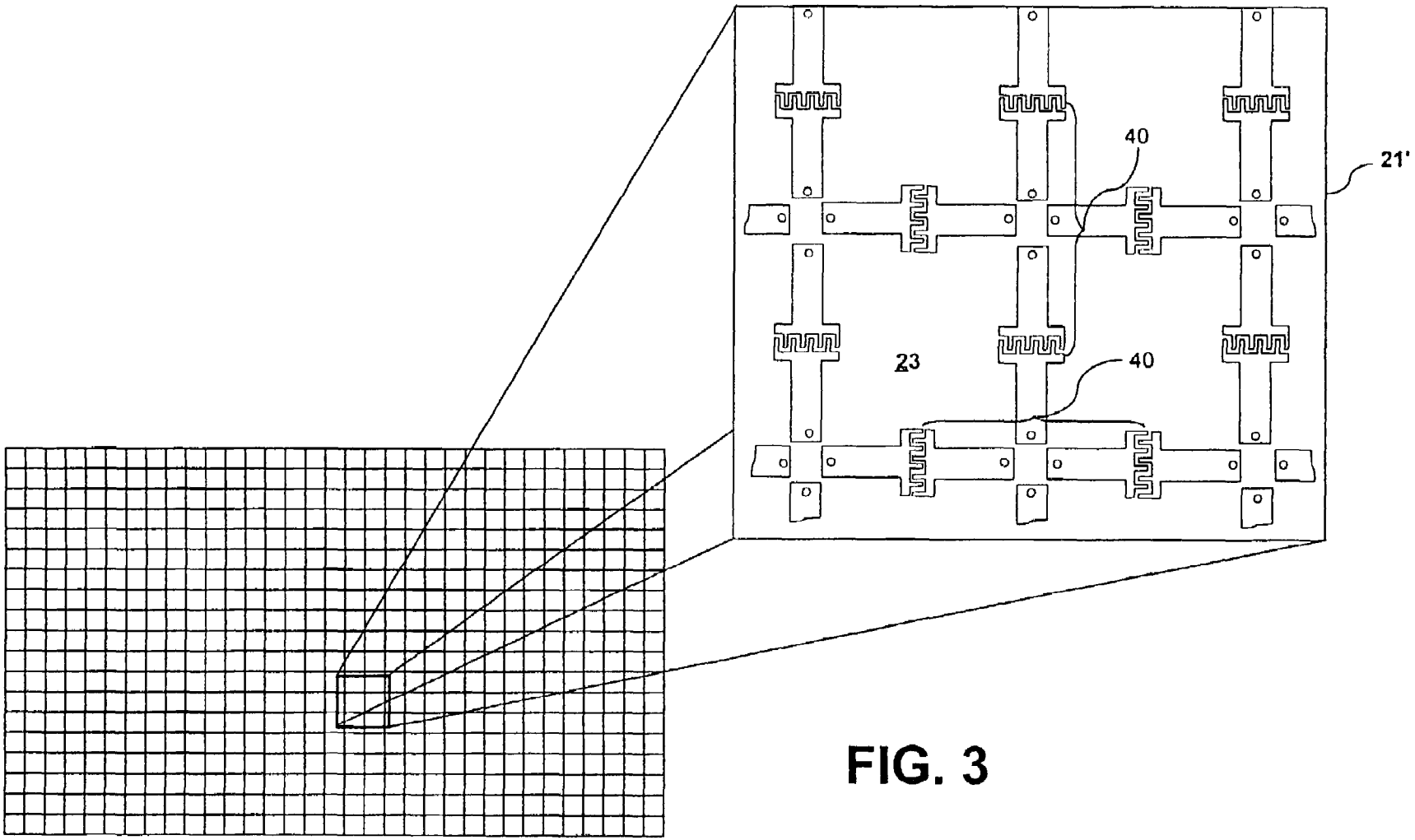
FIG. 3 is a schematic diagram of the printed conductive layer of the wideband phased array antenna of another embodiment of the wideband phased array antenna of FIG. 2.
Figure 4:
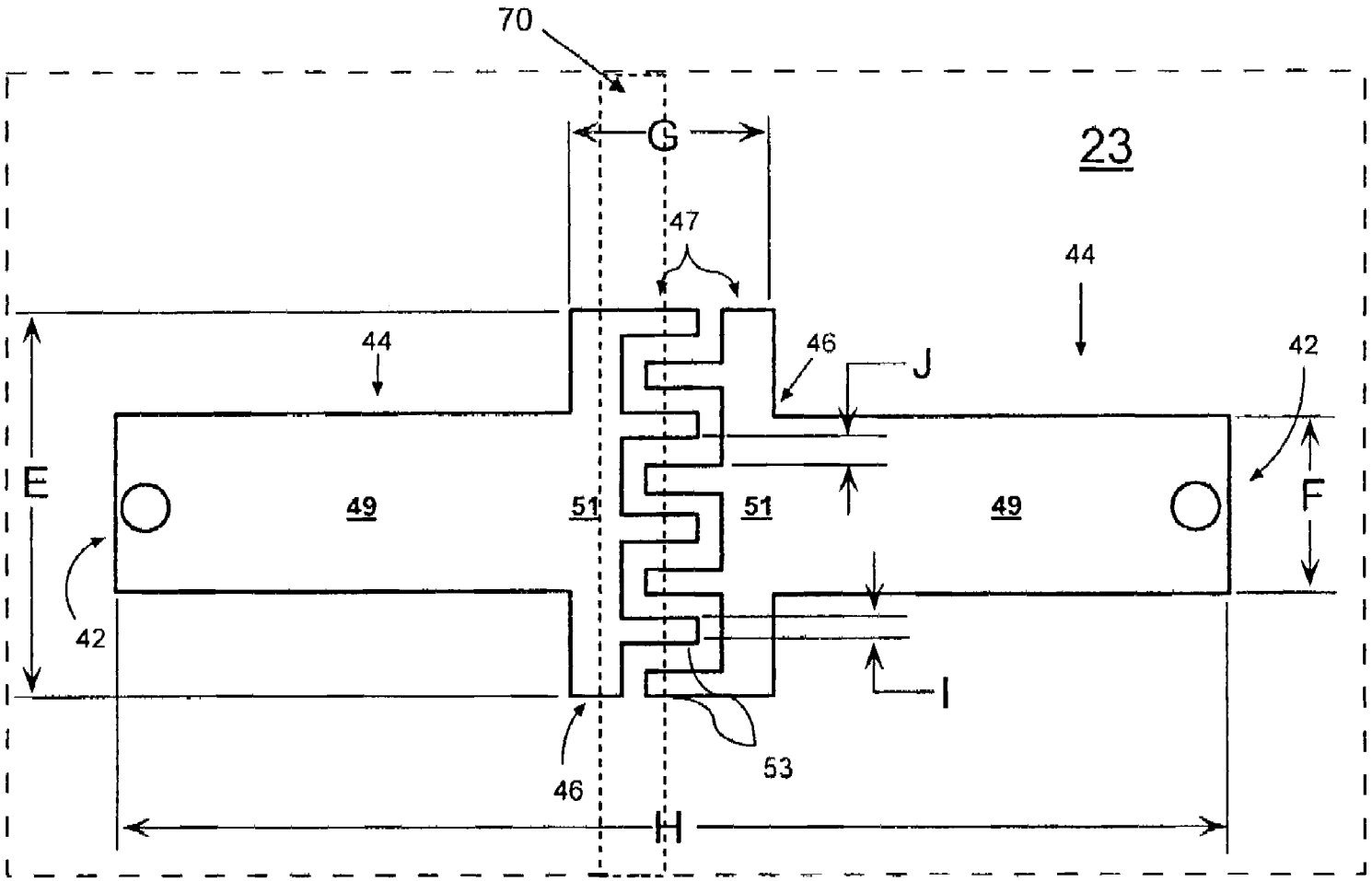
FIGS. 4 and 5 are enlarged schematic views of the spaced apart end portions of adjacent legs of adjacent dipole antenna elements of the alternative embodiments of the wideband phased array antenna of FIG. 2.
Figure 5:
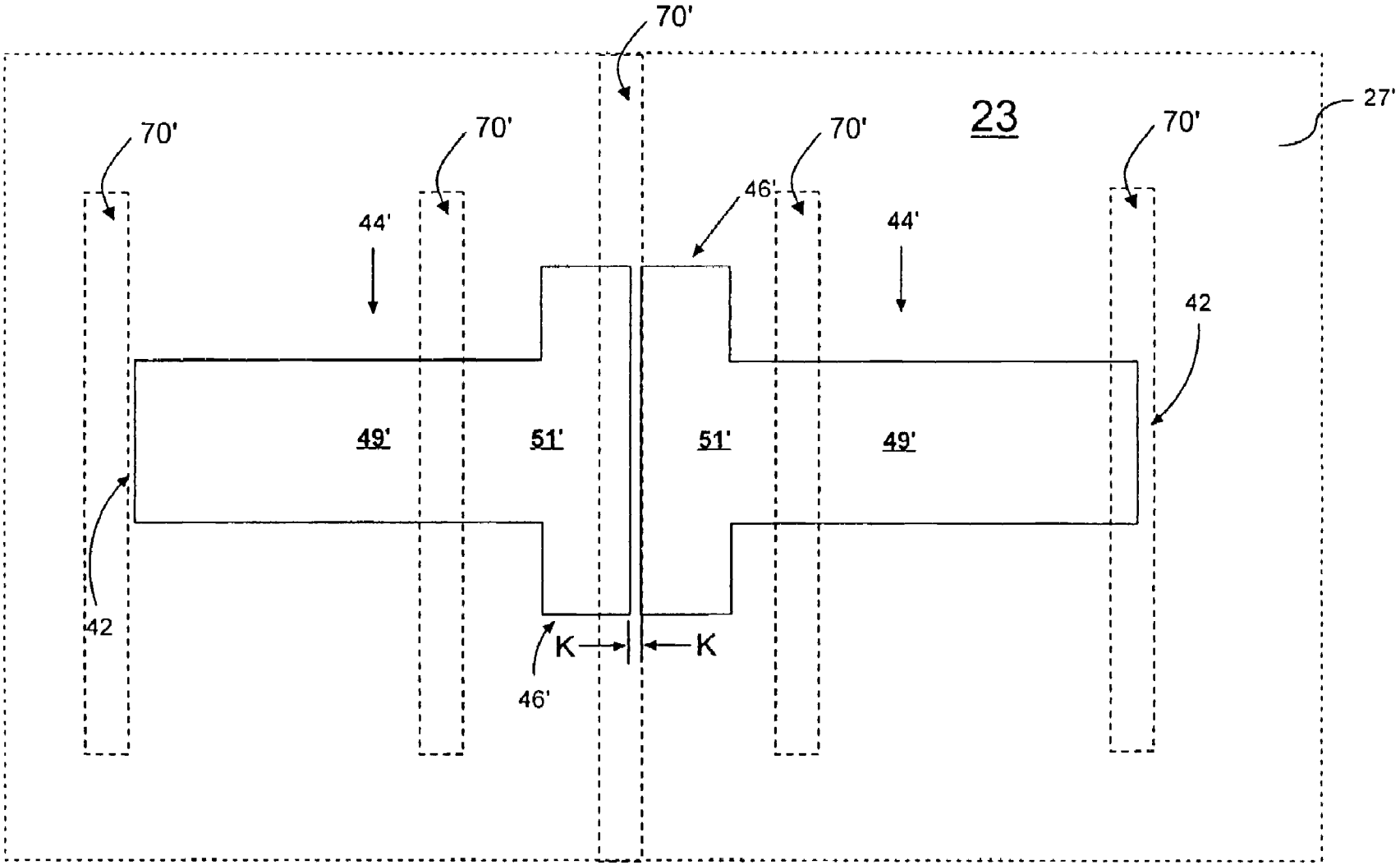

The current sheet array, frequency selective surface or dipole layer typically consists of closely-coupled dipole elements embedded in dielectric layers above a ground plane. Inter-element coupling can be achieved with interdigital capacitors. Coupling can be increased by lengthening the capacitor digits as shown in FIGS. 2–4. The additional coupling provides more bandwidth. Unfortunately, sufficiently long digits will exhibit a gain dropout, such as a 8 dB gain dropout at 15 GHz. It is believed that the capacitors tend to act as a bank of quarter-wave ($\lambda/4$) couplers. An E-field plot (not shown) confirms that cross-polarized capacitors are resonating at a dropout frequency even though only vertically-polarized elements are excited. Despite this, coupling must be maintained to extend the bandwidth of a particular design. The present invention maintains the necessary degree of inter-element coupling by placing coupling plates on separate layers around or adjacent to the interdigital capacitors. Shortening the capacitor digits moves the gain dropout out of band, but reduces coupling and bandwidth. Adding fluidic dielectrics and optionally adding the coupling plates increases the capacitive coupling to maintain or improve bandwidth. The use of fluidic dielectrics and the optional coupling plates can improve bandwidth in simple designs, where no interdigital capacitors are used as shown in FIGS. 5–7.

Composition of the Fluidic Dielectric

The fluidic dielectric can be comprised of any fluid composition having the required characteristics of permittivity and permeability as may be necessary for achieving a selected range of delay. Those skilled in the art will recognize that one or more component parts can be mixed together to produce a desired permeability and permittivity required for a particular time delay or radiated energy shape. In this regard, it will be readily appreciated that fluid miscibility can be a key consideration to ensure proper mixing of the component parts of the fluidic dielectric.

The fluidic dielectric also preferably has a relatively low loss tangent to minimize the amount of RF energy lost in the antenna. Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\in_r$) for fluids is approximately 2.0. However, the fluidic dielectric used herein can include fluids with higher values of permittivity. For example, the fluidic dielectric material could be selected to have a permittivity values of between 2.0 and about 58, depending upon the amount of delay or energy shape required.

Similarly, the fluidic dielectric can have a wide range of permeability values. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 μm are common. The composition of particles can be selected as necessary to achieve the required permeability in the final fluidic dielectric. Magnetic fluid compositions are typically between about 50% to 90% particles by weight. Increasing the number of particles will generally increase the permeability.

Example of materials that could be used to produce fluidic dielectric materials as described herein would include oil (low permittivity, low permeability), a solvent (high permittivity, low permeability) and a magnetic fluid, such as combination of a solvent and a ferrite (high permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing some hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity. Similar techniques could be used to produce fluidic dielectrics with higher permittivity. For example, fluid permittivity could be increased by adding high permittivity powders such as barium titanate manufactured by Ferro Corporation of Cleveland, Ohio.

Referring now to FIGS. 2 and 4, a first embodiment of the dipole layer 21 will now be described. The dipole layer 21 is a printed conductive layer having an array of dipole antenna elements 40 on a flexible substrate 23. Each dipole antenna element 40 can comprise a medial feed portion 42 and a pair of legs 44 extending outwardly therefrom. Respective feed lines are connected to each feed portion 42 from the opposite side of the substrate 23, as will be described in greater detail below. Adjacent legs 44 of adjacent dipole antenna elements 40 have respective spaced apart end portions 46 to provide increased capacitive coupling between the adjacent dipole antenna elements. The adjacent dipole antenna elements 40 have predetermined shapes and relative positioning to provide the increased capacitive coupling. For example, the capacitance between adjacent dipole antenna elements 40 may be between about 0.016 and 0.636 picofarads (pF), and preferably between 0.159 and 0.239 pF.

Preferably, as shown in FIG. 4, the spaced apart end portions 46 in adjacent legs 44 have overlapping or interdigitated portions 47, and each leg 44 comprises an elongated body portion 49, an enlarged width end portion 51 connected to an end of the elongated body portion, and a plurality of fingers 53, for example four fingers extending outwardly from the enlarged width end portion. The antenna elements 40 can further comprise a cavity 70 that runs adjacent to the antenna elements 40. In this instance, it is shown as residing below the gap between the plurality of fingers 53, although the phase array antenna could certainly include many other cavities and in other configurations.

Alternatively, as shown in FIG. 5, adjacent legs 44' of adjacent dipole antenna elements 40 may have respective spaced apart end portions 46' to provide increased capacitive coupling between the adjacent dipole antenna elements. In this embodiment, the spaced apart end portions 46' in adjacent legs 44' comprise enlarged width end portions 51' connected to an end of the elongated body portion 49' to provide the increased capacitive coupling between the adjacent dipole antenna elements. Here, for example, the distance K between the spaced apart end portions 46' can be about 0.003 inches.

Figure 7A:
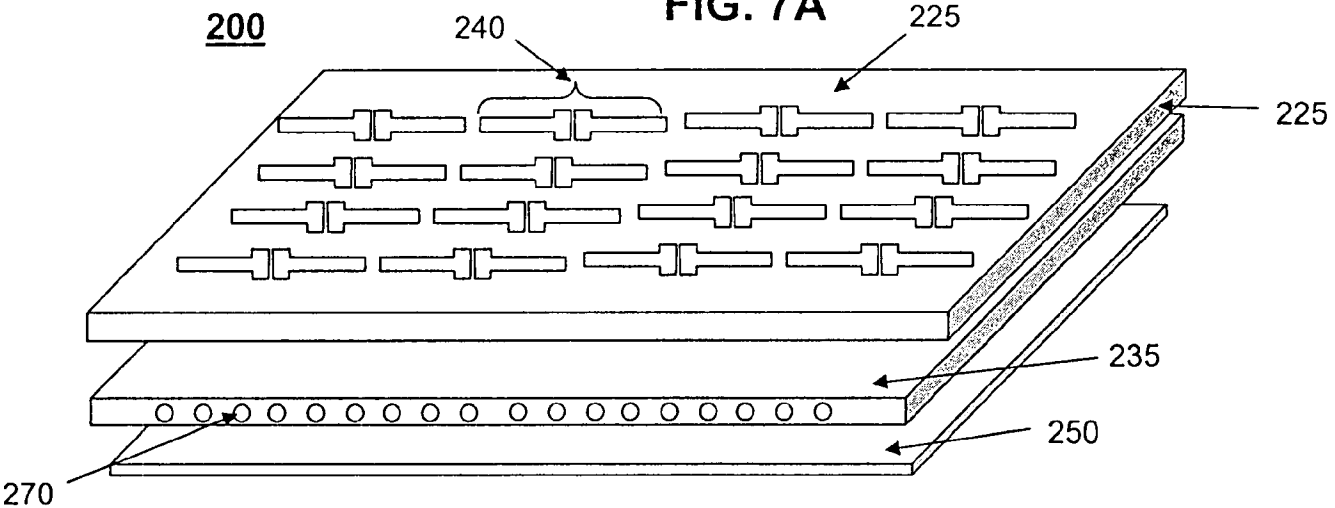
FIG. 7A is an exploded view of a wideband phased array antenna having a frequency selective surface and a dielectric layer with cavities for fluidic dielectrics and a conductive plane in accordance with the present invention.
Figure 7B:
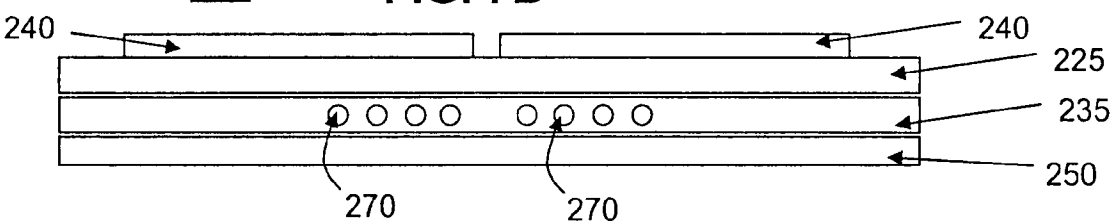
FIG. 7B is a side view of the wideband phased array antenna of FIG. 7A.
Figure 7C:
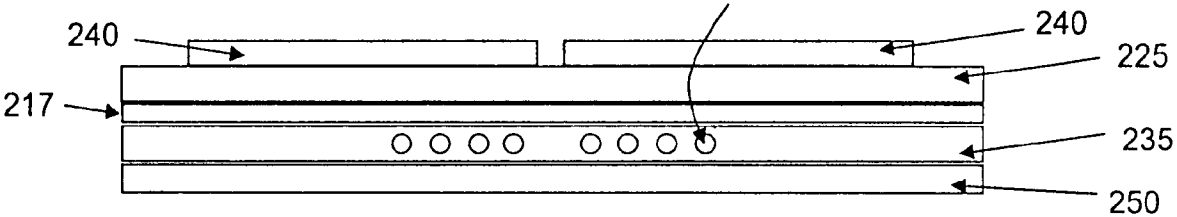
FIG. 7C is an exploded view of an alternative embodiment of the wideband phased array antenna of FIGS. 7A & 7B further including a conductive plane in accordance with the present invention.

As shown in FIG. 7C, coupling plane 217 can reside adjacent to the dipole antenna elements preferably above or below a dipole layer 240. The coupling plane 217 can have metallization on the entire surface of the coupling plane or metallization on select portions of the coupling plane. Of course, other arrangements which increase the capacitive coupling between the adjacent dipole antenna elements are also contemplated by the present invention.

Preferably, the array of dipole antenna elements 40 are arranged at a density in a range of about 100 to 900 per square foot. The array of dipole antenna elements 40 are sized and relatively positioned so that the wideband phased array antenna 10 is operable over a frequency range of about 2 to 30 GHz, and at a scan angle of about ±60 degrees (low scan loss). Such an antenna 10 may also have a 10:1 or greater bandwidth, includes conformal surface mounting, while being relatively lightweight, and easy to manufacture at a low cost.

For example, FIG. 4 is a greatly enlarged view showing adjacent legs 44 of adjacent dipole antenna elements 40 having respective spaced apart end portions 46 to provide the increased capacitive coupling between the adjacent dipole antenna elements. In the example, the adjacent legs 44 and respective spaced apart end portions 46 may have the following dimensions: the length E of the enlarged width end portion 51 equals 0.061 inches; the width F of the elongated body portions 49 equals 0.034 inches; the combined width G of adjacent enlarged width end portions 51 equals 0.044 inches; the combined length H of the adjacent legs 44 equals 0.276 inches; the width I of each of the plurality of fingers 53 equals 0.005 inches; and the spacing J between adjacent fingers 53 equals 0.003 inches. In the example (referring to FIG. 2), the dipole layer 20 may have the following dimensions: a width A of twelve inches and a height B of eighteen inches. In this example, the number C of dipole antenna elements 40 along the width A equals 43, and the number D of dipole antenna elements along the length B equals 65, resulting in an array of 2795 dipole antenna elements.

The wideband phased array antenna 10 has a desired frequency range, e.g. 2 GHz to 18 GHz, and the spacing between the end portions 46 of adjacent legs 44 is less than about one-half a wavelength of a highest desired frequency.

Referring to FIG. 3, another embodiment of the dipole layer 21' may include first and second sets of dipole antenna elements 40 which are orthogonal to each other to provide dual polarization, as would be appreciated by the skilled artisan.

The phased array antenna 10 may be made by forming the array of dipole antenna elements 40 on the flexible substrate 23. This preferably includes printing and/or etching a conductive layer of dipole antenna elements 40 on the substrate 23. As shown in FIG. 3, first and second sets of dipole antenna elements 40 may be formed orthogonal to each other to provide dual polarization.

Again, each dipole antenna element 40 includes the medial feed portion 42 and the pair of legs 44 extending outwardly therefrom. Forming the array of dipole antenna elements 40 includes shaping and positioning respective spaced apart end portions 46 of adjacent legs 44 of adjacent dipole antenna elements to provide increased capacitive coupling between the adjacent dipole antenna elements. Shaping and positioning the respective spaced apart end portions 46 preferably includes forming interdigitated portions 47 (FIG. 4) or enlarged width end portions 51' (FIG. 5). A ground plane (see FIGS. 6–7) is preferably formed adjacent the array of dipole antenna elements 40, and one or more dielectric layers can be layered on either side of the dipole layer with adhesive layers therebetween as is known in the art.

Again referring to FIG. 5, each dipole antenna element 40 includes the medial feed portion 42 and the pair of legs 44' extending outwardly therefrom. Forming the array of dipole antenna elements 40 includes shaping and positioning respective spaced apart end portions 46' of adjacent legs 44' of adjacent dipole antenna elements to provide increased capacitive coupling between the adjacent dipole antenna elements. Shaping and positioning the respective spaced apart end portions 46 preferably includes enlarged width end portions 51'. The antenna elements 40 can further comprise at least one cavity 70' that runs adjacent to the antenna elements 40. In this instance, cavities are shown as residing below the gap between the end portions 46' and in other strategically placed locations, although the phase array antenna could certainly include many other cavities and in other configurations in accordance with the present invention.

As discussed above, the array of dipole antenna elements 40 are preferably sized and relatively positioned so that the wideband phased array antenna 10 is operable over a frequency range of about 2 to 30 GHz, and operable over a scan angle of about ±60 degrees. The antenna 10 may also be mounted on a rigid mounting member 12 having a non-planar three-dimensional shape, such as an aircraft, for example.

Thus, a phased array antenna 10 with a wide frequency bandwith and a wide scan angle is obtained by utilizing tightly packed dipole antenna elements 40 with cavities having fluidic dielectrics and optionally with additional large mutual capacitive coupling. Conventional approaches have sought to reduce mutual coupling between dipoles, but the present invention makes use of, and increases, mutual coupling between the closely spaced dipole antenna elements to prevent grating lobes and achieve the wide bandwidth. The antenna 10 is scannable with a beam former, and each antenna dipole element 40 has a wide beam width. The layout of the elements 40 could be adjusted on the flexible substrate 23 or printed circuit board, or the bean former may be used to adjust the path lengths of the elements to put them in phase.

The present invention can be utilized in a feedthrough lens as described in U.S. Pat. No. 6,417,813 to Timothy Durham, assigned to the assignee herein and hereby incorporated by reference ('813 Patent). As described in the '813 Patent, the feedthrough lens antenna may include first and second phased array antennas (10) that are connected by a coupling structure in back-to-back relation. Again, each of the first and second phased array antennas are substantially similar to the antenna 10 described above. The coupling structure may include a plurality of transmission elements each connecting a corresponding dipole antenna element of the first phased array antenna with a dipole antenna element of the second phased array antenna. The transmission elements may be coaxial cables, for example, as illustratively shown in FIG. 6 of the '813 Patent.

By using the wide bandwidth phased array antenna 10 described above, the feedthrough lens antenna of the present invention will advantageously have a transmission passband with a bandwidth on the same order. Similarly, the feedthrough lens antenna will also have a substantially unlimited reflection band, since the phased array antenna 10 is substantially reflective at frequencies below its operating band. Scan compensation may also be achieved. Additionally, the various layers of the first and second phased array antennas may be flexible as described above, or they may be more rigid for use in applications where strength or stability may be necessary, as will be appreciated by those of skill in the art.

Whether the wideband phased array antenna 10 is used by itself or incorporated in a feedthrough lens antenna, the present invention can preferably be used with applications requiring a continuous bandwidth of 9:1 or greater and certainly extends the operational bandwidth of current sheet arrays or dipole layers as described herein.

Figure 6A:
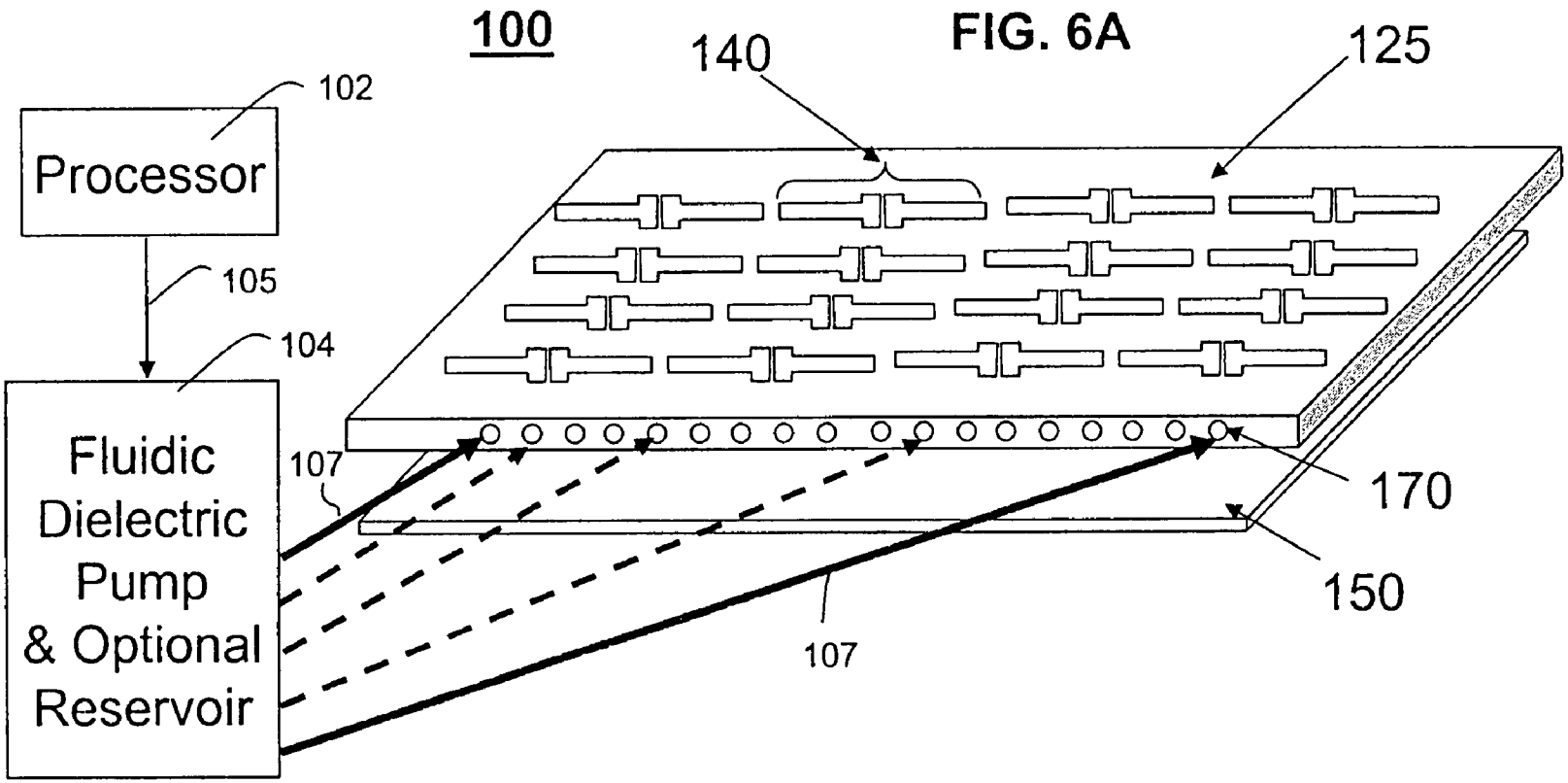
FIG. 6A is an exploded view of a wideband phased array antenna having a frequency selective surface with cavities for fluidic dielectrics in accordance with the present invention.
Figure 6B:
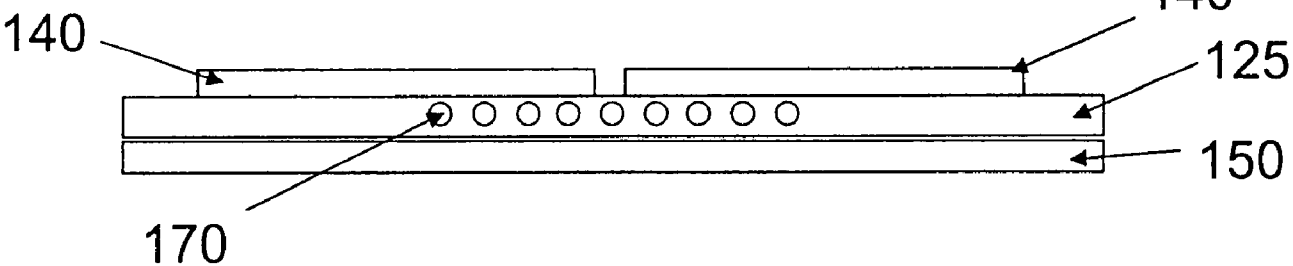
FIG. 6B is a side view of the wideband phased array antenna of FIG. 6A.

Referring to FIGS. 6A and 6B, a schematic diagram and a side view respectively of an antenna system 100 having at least one cavity (and in this embodiment a plurality of cavities 170) that can contain at least one fluidic dielectric having a permittivity and a permeability is shown. The cavities 170 can be a plurality of tubes such as quartz capillary tubes formed within a frequency selective surface (or current sheet array or dipole layer) comprised of a substrate 125 having an array of antenna elements 140 such as dipole antenna elements formed on the substrate 125. The antenna 100 also preferably includes a conductive ground layer 150 beneath the frequency selective surface and more particularly underneath substrate 125. Note that antenna 100 is described as an exemplary embodiment and that the invention is not limited to such arrangement in terms of cavities, antenna elements, or construction.

The antenna 100 can further include at least one composition processor or pump 104 adapted for dynamically changing a composition of the fluidic dielectric to vary at least the permittivity and/or permeability in any of the plurality of cavities 170. It should be understood that the at least one composition processor can be independently operable for adding and removing the fluidic dielectric from each of said plurality of cavities. The fluidic dielectric can be moved in and out of the respective cavities using feed lines 107 for example. The antenna 100 can further include a controller or processor 102 for controlling the composition processor 104 to selectively vary at least one of the permittivity and/or the permeability in at least one of the plurality of cavities in response to a control signal. As previously described, the fluidic dielectric used in the cavities can be comprised of an industrial solvent having a suspension of magnetic particles. The magnetic particles are preferably formed of a material selected from the group consisting of ferrite, metallic salts, and organo-metallic particles although the invention is not limited to such compositions.

Referring again to FIG. 6A, the controller or processor 102 is preferably provided for controlling operation of the antenna 100 in response to a control signal 105. The controller 102 can be in the form of a microprocessor with associated memory, a general purpose computer, or could be implemented as a simple look-up table.

For the purpose of introducing time delay or energy shaping in accordance with the present invention, the exact size, location and geometry of the cavity structure as well as the permittivity and permeability characteristics of the fluidic dielectric can play an important role. The processor and pump or flow control device (102 and 104) can be any suitable arrangement of valves and/or pumps and/or reservoirs as may be necessary to independently adjust the relative amount of fluidic dielectric contained in the cavities 170. Even a MEMS type pump device (not shown) can be interposed between the cavity or cavities and a reservoir for this purpose. However, those skilled in the art will readily appreciate that the invention is not so limited as MEMS type valves and/or larger scale pump and valve devices can also be used as would be recognized by those skilled in the art.

The flow control device can ideally cause the fluidic dielectric to completely or partially fill any or all of the cavities 170. The flow control device can also cause the fluidic dielectric to be evacuated from the cavity into a reservoir. According to a preferred embodiment, each flow control device is preferably independently operable by controller 102 so that fluidic dielectric can be added or removed from selected ones of the cavities 170 to produce the required amount of delay indicated by a control signal 105.

Referring to FIG. 7A and 7B, a schematic diagram and a side view respectively of an alternative antenna system 200 similar to antenna system 100 is shown. Antenna system 200 preferably includes at least one cavity 270 that can contain at least one fluidic dielectric. The antenna system generally comprises a frequency selective surface including antenna members 240 on a substrate 225. Additionally, antenna system 200 further includes a conductive ground plane 250 below the substrate 225. In this embodiment, the cavity or cavities 270 are formed within a separate substrate 235 (apart from the frequency selective surface) as opposed to the cavities 170 formed in the substrate 125 of the frequency selective surface of antenna system 100 of FIGS. 6A and 6B. As clearly shown in FIG. 7B, the substrate 235 is placed between substrate 225 and ground plane 250.

In one further variation of the present invention as illustrated in FIG. 7C, the antenna system 200 can further comprise a conductive plane 217 in addition to the elements previously described with respect to FIG. 7B. As previously described, the conductive plane 217 provides additional coupling among the antenna elements 240. The conductive plane 217 can be positioned between substrate 225 and substrate 235 as shown, although the present invention is not limited to such arrangement. In any event, each of the embodiment described in accordance with the present invention should be able to change the phase response or the resonant frequency across the frequency selective surface in order to remove undesirable characteristics.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A phased array antenna having a frequency selective surface, comprising:

a substrate and an array of antenna elements thereon, each antenna element comprising a medial feed portion and a pair of legs extending outwardly therefrom, adjacent legs of adjacent antenna elements including respective spaced apart end portions;

at least one fluidic dielectric having a permittivity and a permeability residing within at least one cavity within the substrate and arranged between a plane where the array of antenna elements reside and a ground plane;

at least one composition processor adapted for dynamically changing a composition of said fluidic dielectric to vary at least one of said permittivity and said permeability in said at least one cavity; and a controller for controlling said composition processor to selectively vary at least one of said permittivity and said permeability in at least one cavity in response to a control signal.

2. The frequency selective surface of claim 1, wherein said at least one cavity comprises a plurality of quartz capillary tubes.

3. The frequency selective surface of claim 1, wherein each of said at least one composition processor is independently operable for adding and removing said fluidic dielectric from each of said at least one cavity.

4. The frequency selective surface according to claim 1, wherein said fluidic dielectric is comprised of an industrial solvent.

5. The frequency selective surface according to claim 4, wherein said fluidic dielectric is comprised of an industrial solvent that has a suspension of magnetic particles contained therein.

6. The frequency selective surface according to claim 5, wherein said magnetic particles are formed of a material selected from the group consisting of ferrite, metallic salts, and organo-metallic particles.

7. The frequency selective surface according to claim 1, wherein the array of antenna elements comprises an array of dipole antenna elements.

8. The frequency selective surface according to claim 1, wherein the array of antenna elements comprises an array of slot antenna elements.

9. A phased array antenna, comprising:

a substrate and an array of antenna elements thereon, each antenna element comprising a medial feed portion and a pair of legs extending outwardly therefrom, adjacent legs of adjacent antenna elements including respective spaced apart end portions;

at least one fluidic dielectric having a permittivity and a permeability able to reside within at least one cavity within at least one dielectric layer, wherein the dielectric layer resides between the substrate and a ground plane;

at least one composition processor adapted for dynamically changing a composition of said fluidic dielectric to vary at least one of said permittivity and said permeability in said at least one cavity; and a controller for controlling said composition processor to selectively vary at least one of said permittivity and said permeability in at least one cavity in response to a control signal.

10. The phased array antenna of claim 9, wherein the phased array antenna further comprises at least one conductive plane adjacent to the substrate for providing additional coupling between adjacent dipole antenna elements.

11. The phased array antenna according to claim 9, wherein the phased array antenna has a desired frequency range and wherein said ground plane is spaced from the array of dipole antenna elements less than about one-half a wavelength of a highest desired frequency.

12. The phased array antenna according to claim 9, wherein the spaced apart end portions in the adjacent legs comprise interdigitated portions.

13. The phased array antenna according to claim 12, wherein each leg comprises an elongated body portion, an enlarged width end portion connected to an end of the elongated body portion, and a plurality of fingers extending outwardly from said enlarged width end portion.

14. The phased array antenna according to claim 9 wherein each phased array antenna has a desired frequency range and wherein the spacing between the end portions of adjacent legs is less than about one-half a wavelength of a highest desired frequency.

15. The phased array antenna according to claim 9, wherein the array of dipole antenna elements comprises first and second sets of orthogonal dipole antenna elements to provide dual polarization.

16. The phased array antenna of claim 9, wherein the phased array antenna forms a part of a feedthrough lens antenna having a coupling structure connecting a first and a second phased array antenna together in back-to-back relation.

17. The phased array antenna according to claim 16, wherein said coupling structure comprises a ground plane.

18. The phased array antenna according to claim 9, wherein the at least one conductive plane resides between the substrate and the ground plane.

19. The phased array antenna of claim 9, wherein said at least one composition processor dynamically changes the composition of said fluidic dielectric by mixing fluidic dielectric having different permittivity and permeability values.

20. A phased array antenna, comprising:

a current sheet array on a substrate;

at least one dielectric layer between the current sheet array and a ground plane; and at least one cavity within said at least one dielectric layer for retaining at least one fluidic dielectric having a permittivity and a permeability;

at least one fluidic pump unit for adding and removing said at least one fluid dielectric to and from said at least one cavity in response to a control signal.

21. The phased array antenna according to claim 20, wherein the current sheet array comprises the substrate carrying an array of dipole antenna elements.

22. The phased array antenna of claim 21, wherein the phased array antenna further comprises at least one conductive plane adjacent to the substrate for providing additional coupling between adjacent dipole antenna elements of the current sheet array.

* * * * *